US008210527B2

(12) United States Patent
Kawaguchi et al.

(10) Patent No.: US 8,210,527 B2
(45) Date of Patent: Jul. 3, 2012

(54) PAPER EJECTING DEVICE WITH SWINGING PROTRUDING MEMBERS

(75) Inventors: Akira Kawaguchi, Wakayama (JP); Katsunori Takahashi, Wakayama (JP)

(73) Assignees: Duplo Seiko Corporation, Wakayama (JP); Seiko Epson Corporation, Tokyo (JP)

( * ) Notice: Subject to any disclaimer, the term of this patent is extended or adjusted under 35 U.S.C. 154(b) by 78 days.

(21) Appl. No.: 12/356,983

(22) Filed: Jan. 21, 2009

(65) Prior Publication Data

US 2009/0212497 A1 Aug. 27, 2009

(30) Foreign Application Priority Data

Feb. 26, 2008 (JP) ..... 2008-043677

(51) Int. Cl.
*B65H 29/38* (2006.01)

(52) U.S. Cl. ..... 271/197; 271/188; 271/200; 271/209; 271/213

(58) Field of Classification Search ..... 271/189, 271/200, 202, 213, 307, 308, 194–197, 900, 271/209
See application file for complete search history.

(56) References Cited

U.S. PATENT DOCUMENTS

| | | | | |
|---|---|---|---|---|
| 3,500,999 | A * | 3/1970 | Lippke | 209/587 |
| 3,780,960 | A * | 12/1973 | Tokuno et al. | 242/555.2 |
| 3,805,683 | A * | 4/1974 | Hook | 493/194 |
| 4,030,727 | A * | 6/1977 | Jeschke | 271/276 |
| 4,702,471 | A * | 10/1987 | Smith et al. | 271/284 |
| 4,819,928 | A * | 4/1989 | Osborn et al. | 271/276 |
| 5,026,249 | A * | 6/1991 | Shill | 414/789.1 |
| 5,108,083 | A * | 4/1992 | Russel et al. | 271/3.01 |
| 5,160,132 | A * | 11/1992 | Hanada | 271/258.01 |
| 5,201,513 | A * | 4/1993 | Mion | 271/180 |
| 5,404,805 | A * | 4/1995 | Fujimoto et al. | 271/188 |
| 5,690,324 | A | 11/1997 | Otomo et al. | |
| 5,951,007 | A * | 9/1999 | Greive et al. | 271/276 |
| 5,979,890 | A * | 11/1999 | Fujimaki et al. | 271/195 |
| 6,460,844 | B1 * | 10/2002 | Clifford et al. | 271/9.13 |
| 6,503,011 | B2 * | 1/2003 | Kono | 271/188 |
| 2001/0015144 | A1 * | 8/2001 | Tsurumaki | 101/232 |
| 2004/0251606 | A1 * | 12/2004 | Mayerberg et al. | 271/197 |
| 2009/0174138 | A1 * | 7/2009 | Abe | 271/276 |
| 2010/0109235 | A1 * | 5/2010 | Sugiyama et al. | 271/276 |

FOREIGN PATENT DOCUMENTS

| | | |
|---|---|---|
| JP | 56-61266 | 5/1981 |
| JP | 61-217461 | 9/1986 |
| JP | 6-239000 | 8/1994 |
| JP | 6-239001 | 8/1994 |
| JP | 8-169628 | 7/1996 |
| JP | 2001-010195 | 1/2001 |
| JP | 2001-058751 | 3/2001 |
| JP | 2001-58751 | 3/2001 |
| JP | 2005-335908 | 12/2005 |

* cited by examiner

*Primary Examiner* — Gerald McClain
(74) *Attorney, Agent, or Firm* — Fildes & Outland, P.C.

(57) ABSTRACT

A paper ejecting device with a plurality of swinging protruding members is provided which allows a sheet jumping from a paper ejecting device to a paper receiving tray to be ejected with a desired shape by changing the corrected shape of the sheet according to the kind (size, thickness) of paper.

6 Claims, 10 Drawing Sheets

PAPER EJECTING DEVICE WITH SWINGING PROTRUDING MEMBERS

FIELD OF THE INVENTION

The present invention relates to a paper ejecting device for ejecting sheets of paper from a machine such as a stencil duplicator to a paper receiving tray and the like, and relates to a technique for adjusting the shape of an ejected sheet to a predetermined shape during ejection.

BACKGROUND OF THE INVENTION

In a stencil duplicator of the prior art, printed sheets of paper are transported by a paper sucking transport belt and are ejected from a paper ejecting device to a paper receiving tray. The paper ejecting device includes a so-called jumping board for adjusting the shape of an ejected sheet, which jumps from the paper ejecting device to the paper receiving tray, to a predetermined shape. With the jumping board, the shape of the ejected sheet is curved to a U-shape (a shape in cross section orthogonal to a transport direction) so as to raise the sheet ends provided in parallel with an axis disposed along a jumping direction.

By forming the shape of the ejected sheet into a U-shape thus, the rigidity of the sheet, that is, the stiffness of the sheet is increased in an axial direction along the transport direction. Thus the leading end of the sheet is prevented from hanging down while the sheet jumps from the paper ejecting device to the paper receiving tray, and the sheet is placed on a predetermined position on the paper receiving tray. Such a technique is described in Japanese Patent Laid-Open No. 56-61266.

Further, Japanese Patent Laid-Open No. 61-217461 describes a configuration for ejecting a sheet of paper while restricting the sheet to a wavy shape along a width direction by a guide member provided along a paper transport direction on a paper transport surface.

Moreover, Japanese Patent Laid-Open No. 2001-58751 describes a configuration in which both edges of a sheet of paper transported on a belt conveyor are guided so as to be raised by an inclined guide member and the sheet is curved into a W-shape substantially at the center of the width of the sheet by protruding members protruding from below to above on a paper transport surface. The urging force of a spring for urging the protruding members in a protruding direction depends upon the stiffness of the sheet.

Further, Japanese Patent Laid-Open No. 6-239000 and Japanese Patent Laid-Open No. 6-239001 each describe a configuration in which movable protruding members are provided so as to move vertically at some points in a paper ejection path for guiding printed sheets of paper, the movable protruding members are vertically driven according to the size of a sheet by a cam driving device, and the heights and positions of the movable members are changed according to the size of the sheet.

In the configuration of the prior art, when a sheet is curved into a W-shape, the amounts of protrusion of the protruding members can be adjusted according to the size and stiffness of the sheet. However, the shape of the ejected sheet which jumps from a paper ejecting device to a paper receiving tray basically remains the same all the time.

However, depending on the kind of paper (size, thickness), the shape of an ejected sheet which jumps from the paper ejecting device to the paper receiving tray may not be adjusted to a desired shape only by curving the sheet into a W-shape.

The present invention has been devised to solve the problem. An object of the present invention is to provide a paper ejecting device for adjusting the shape of an ejected sheet, which jumps from a paper ejecting device to a paper receiving tray, to a desired shape by changing the corrected shape of the sheet according to the kind (size, thickness) of paper and the bias of a surface print rate on the sheet.

DISCLOSURE OF THE INVENTION

In order to solve the problem, a paper ejecting device of the present invention includes: a body having a plurality of suction transport belts for transporting a sheet of paper by suction along a paper transport surface; jumping boards provided on both sides of the body along a paper transport direction; a plurality of protruding members which are disposed on the sides of the suction transport belts so as to independently swing up and down around the axis of a swinging shaft for supporting one ends of the protruding members; swinging devices for swingingly driving the protruding members from a position where the protruding members have top portions composing the other ends of the protruding members and protruding upward to a predetermined height from the paper transport surface to a position where the overall protruding members retract below the paper transport surface; and a controller for controlling the swinging devices and combining the swinging positions of the protruding members according to one of the kind of paper and the bias of the surface print rate of the sheet.

A paper ejecting device of the present invention includes: a body for sucking a sheet of paper on a paper transport surface; jumping boards provided on both sides of the body along a paper transport direction; a plurality of protruding members disposed so as to independently swing up and down around the axis of a swinging shaft for supporting one ends of the protruding members; swinging devices for swingingly driving the protruding members from a position where the protruding members have top portions composing the other ends of the protruding members and protruding upward to a predetermined height from the paper transport surface to a position where the overall protruding members retract below the paper transport surface; and a controller for controlling the swinging devices and combining the swinging positions of the protruding members according to one of the kind of paper and the bias of the surface print rate of the sheet, wherein each of the protruding members has a suction transport belt for transporting the sheet by suction along the paper transport direction.

The paper ejecting device further includes an air blower for blowing air so as to press the sheet to the paper transport surface.

Further, the controller adjusts the transport speed of the suction transport belt according to the kind of paper.

As has been discussed, according to the present invention, by combining the numbers and positions of protruding members protruding from a paper transport surface, the corrected shape of a sheet can be changed according to the kind (size, thickness) of paper and the bias of the surface print rate of the sheet, so that the sheet jumping from a paper ejecting device to a paper receiving tray can be ejected with a desired shape. Correction can be improved by blowing air so as to press the sheet to the paper transport surface. Since the protruding members include suction transport belts, the sheet can be positively ejected with a desired shape.

DESCRIPTION OF THE EMBODIMENTS

Figure 10:
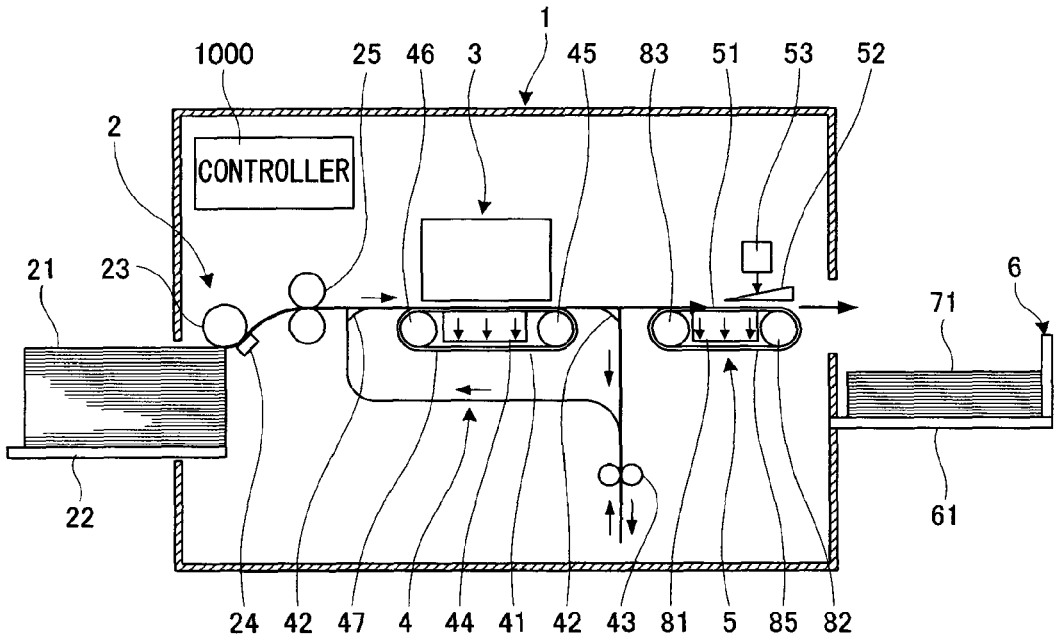
FIG. 10 is a schematic view showing the configuration of an ink-jet printer.

Embodiments of the present invention will be described below in accordance with the accompanying drawings. Referring to FIG. 10, the following will first describe a printer using a paper ejecting device of the present invention.

Figure 11:
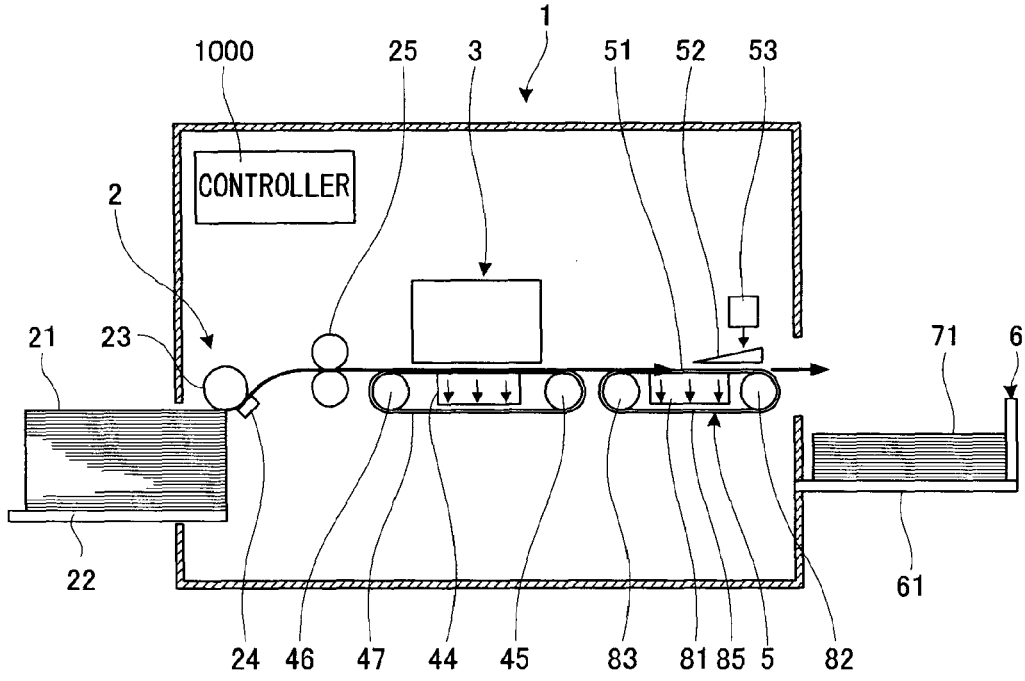
FIG. 11 is a schematic view showing another configuration of the ink-jet printer.

In the following explanation, an ink-jet printer will be illustrated as an application of the paper ejecting device of the present invention. The paper ejecting device of the present invention is also applicable to a stencil duplicator, a screen printer, and so on. The ink-jet printer may be configured both for single-sided and double-sided printing as shown in FIG. 10 or the ink-jet printer may be configured only for single-sided printing as shown in FIG. 11. In the following explanation, the ink-jet printer will be described with reference to FIG. 10. The configurations of FIG. 11 are indicated by the same reference numerals as in FIG. 10 and the explanation thereof is omitted.

In FIG. 10, an ink-jet printer 1 is made up of a paper feed mechanism 2, a printer body 3, a paper transport mechanism 4, a paper ejecting device 5, a paper receiving mechanism 6, and a controller 1000 acting as a control unit of each mechanism.

The paper feed mechanism 2 includes a feed tray 22 for loading sheets 21, a feed roller 23 and a feed pad 24 which transport the sheets 21 one by one from the feed tray 22, and a pair of upper and lower transport rollers 25 for supplying the transported sheets 21 to the printer body 3.

In this case, the printer body 3 performs printing by spraying water based ink onto a sheet surface according to an ink-jet printing system.

In the paper transport mechanism 4, a transport path is formed by a combination of a plurality of transport units 41, gates 42, and a pair of reversing rollers 43. To avoid complication in the drawing, only the transport unit 41 corresponding to the printer body 3 is shown. The gates 42 are disposed at the branch points and junctions of the transport path made up of the plurality of transport units 41, and the transport path is switched by operating the gates 42.

The transport unit 41 includes a suction box 44 communicating with the suction source, a pair of a driving roller 45 and a driven roller 46 which are disposed at the front and rear of the suction box 44, and a paper suction transport belt 47 looped over the rollers 45 and 46 at the front and rear. The sheets 21 are transported on the upper surface of the paper suction transport belt 47 by sucking air through a plurality of holes formed on the suction box 44 and the paper suction transport belt 47.

The paper receiving mechanism 6 includes a paper receiving tray 61 for receiving printed sheets 71 which are ejected from the paper ejecting device 5.

The paper ejecting device 5 transports the printed sheets 71 by sucking air and includes a body 51, jumping boards 52 disposed on both sides of the body 51, an air blower 53 for blowing air to the paper transport surfaces of the jumping boards 52 with a fan and the like.

The air blower 53 blows air from the center to both sides of a sheet, blows air directly below the air blower 53 in a direction perpendicular to the paper transport surface, or blows air to the front in a paper transport direction at a certain angle. The blowing directions may be combined. Further, the air intensity of the air blower 53 may be controlled according to the kind of paper.

Figure 1:
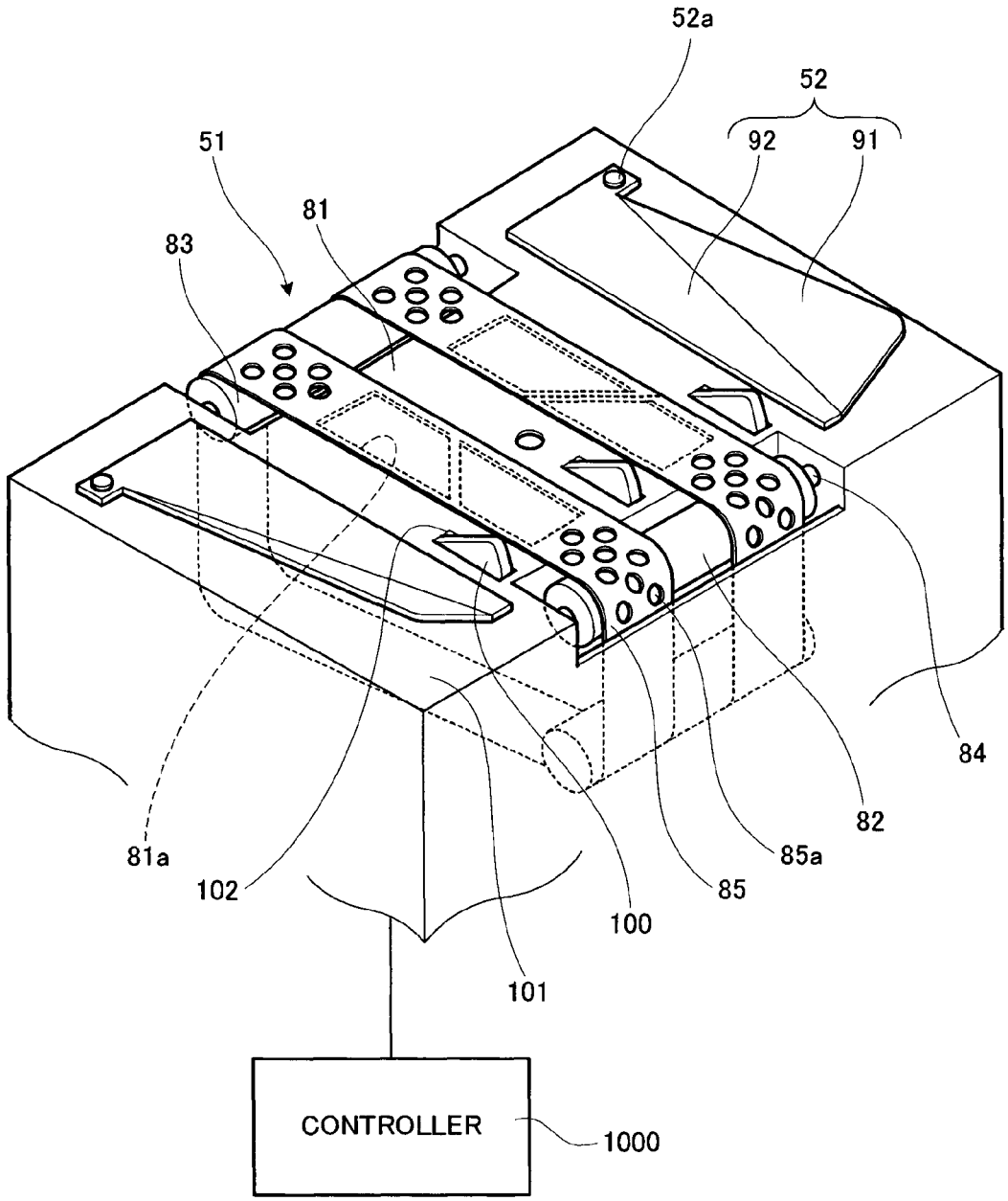
FIG. 1 is a perspective view showing a paper ejecting device according to an embodiment of the present invention.
Figure 2:
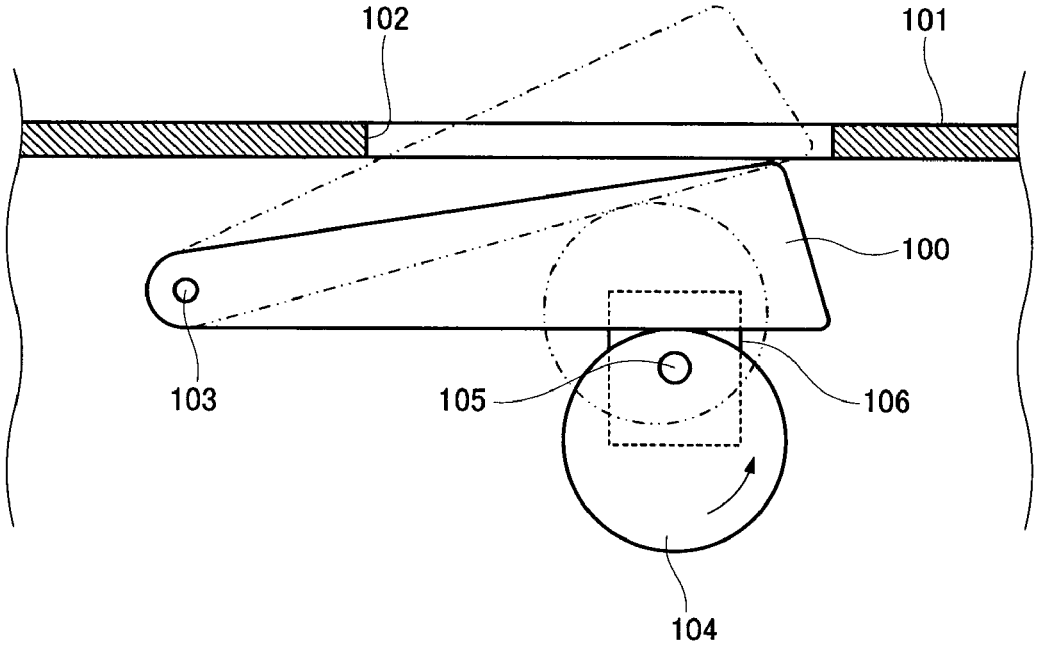
FIG. 2 is a main part enlarged view showing a protruding member according to the embodiment.
Figure 3:
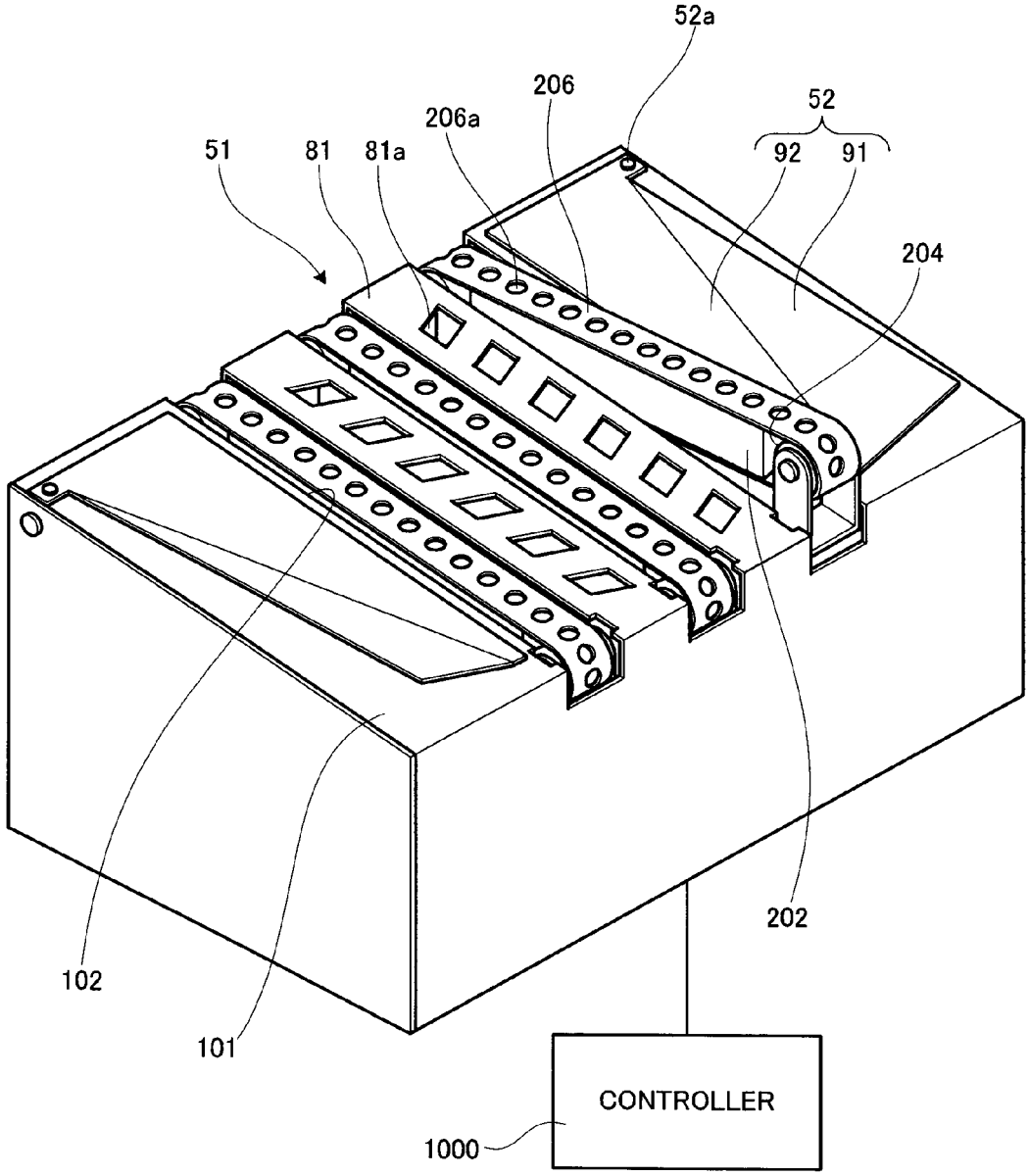
FIG. 3 is a perspective view showing a paper ejecting device according to another embodiment of the present invention.
Figure 4:
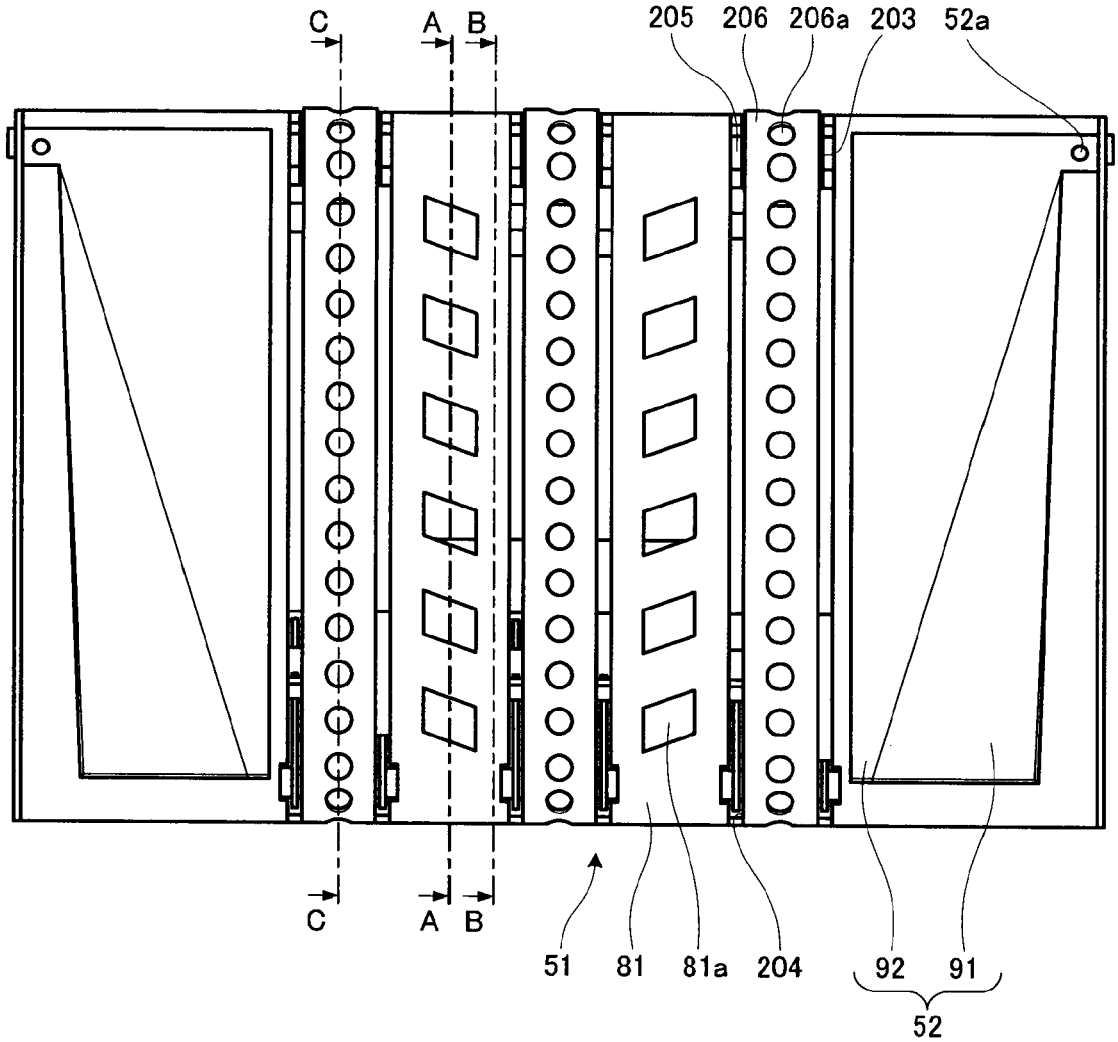
FIG. 4 is a plan view showing the paper ejecting device according to the embodiment.
Figure 5:
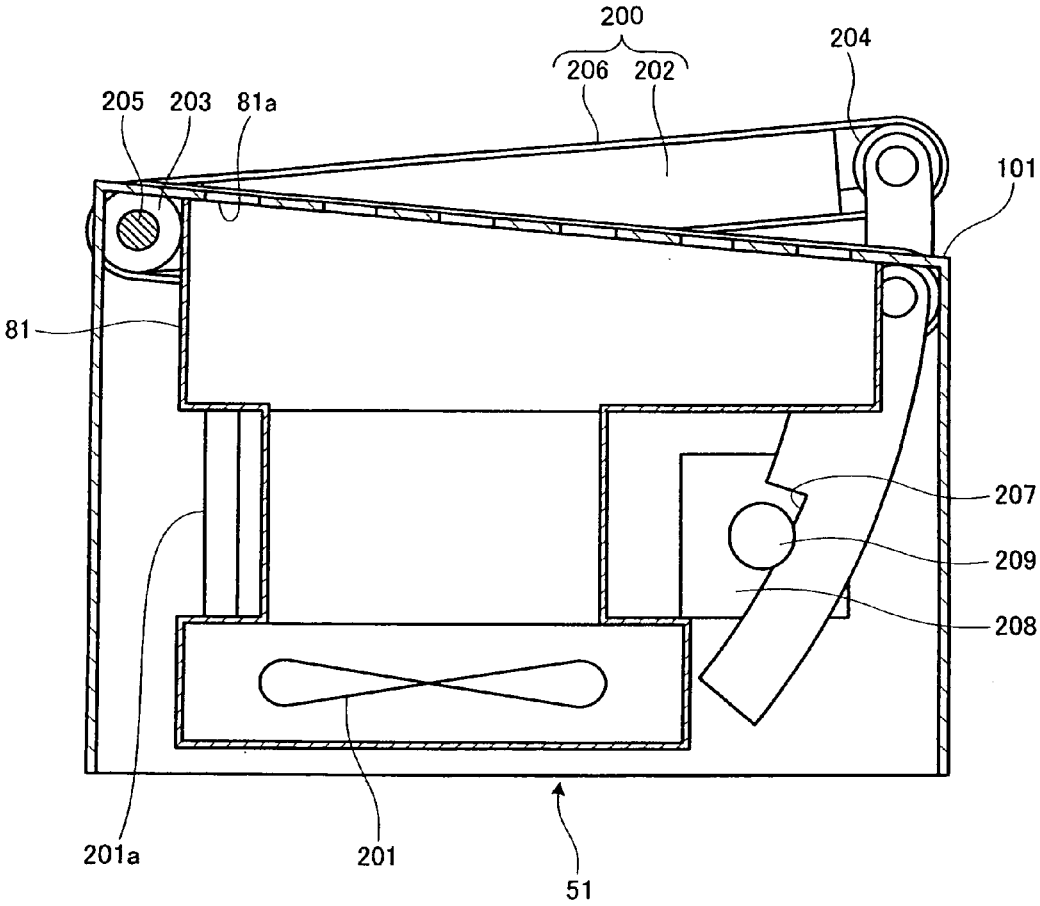
FIG. 5 is a sectional view taken along line A-A of FIG. 4.
Figure 6:
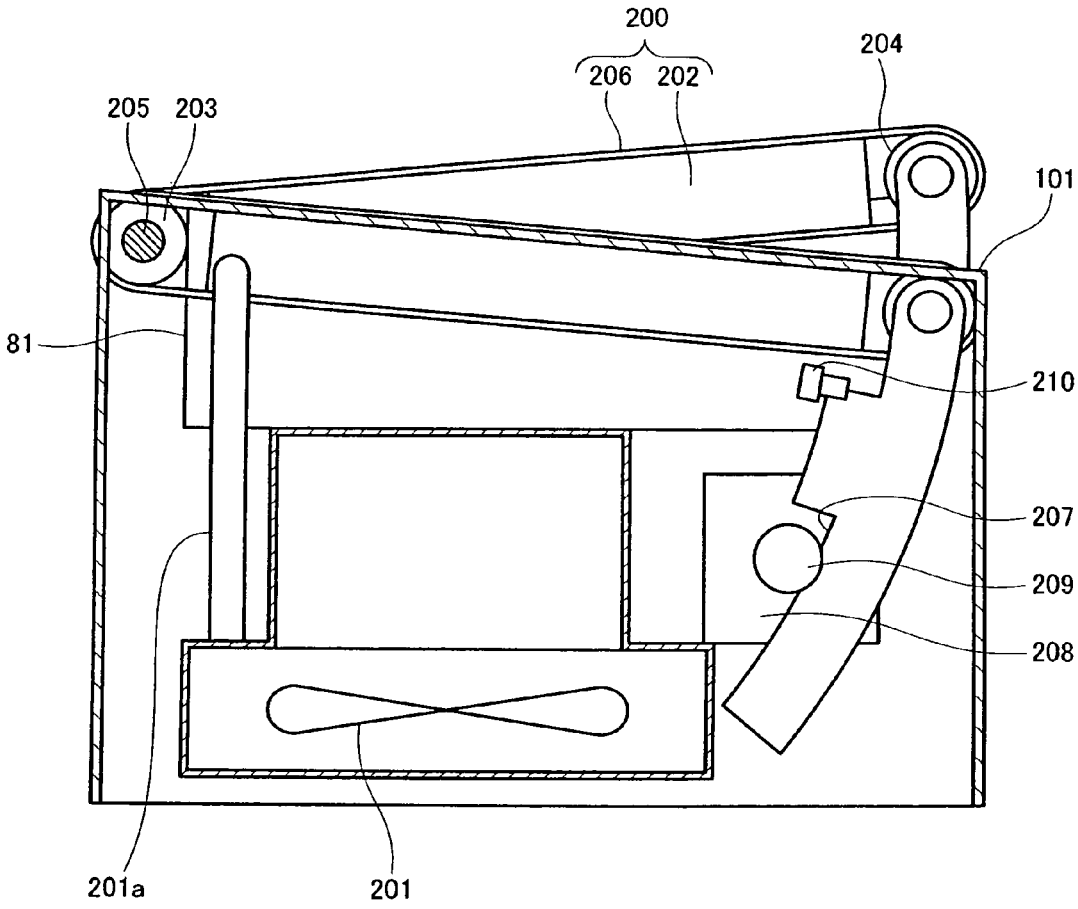
FIG. 6 is a sectional view taken along line B-B of FIG. 4.
Figure 7:
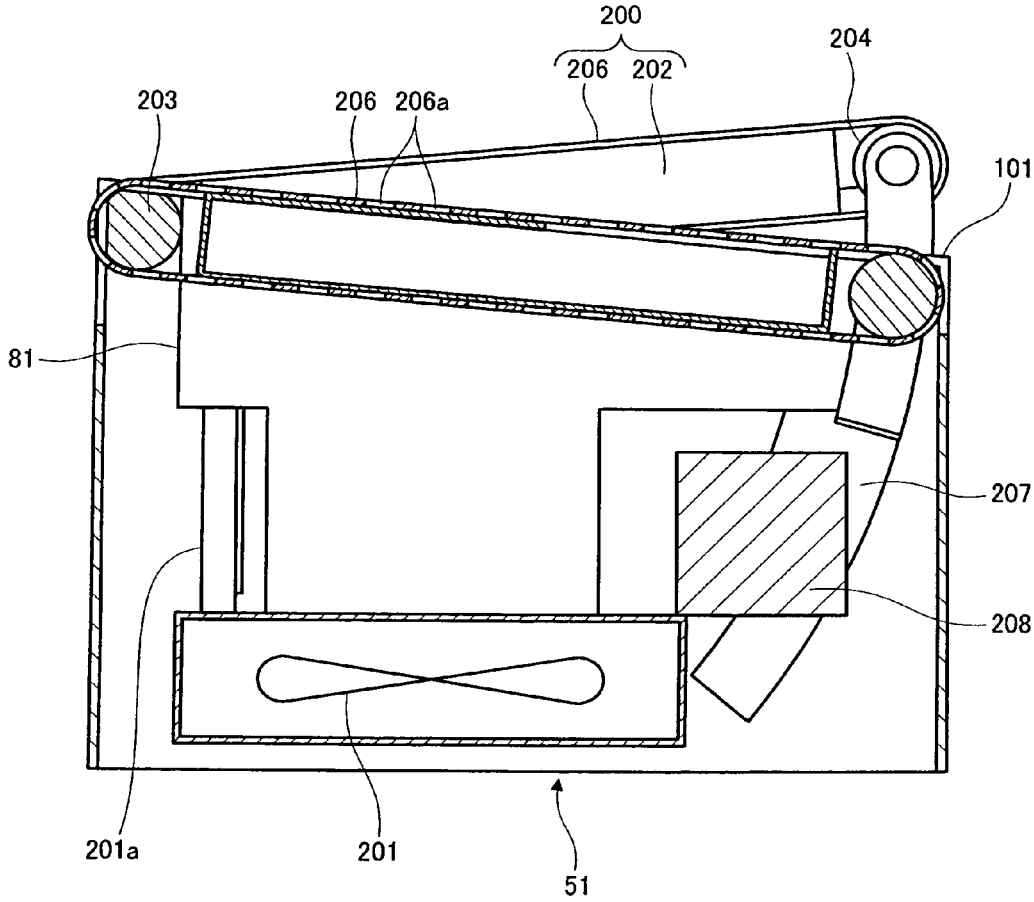
FIG. 7 is a sectional view taken along line C-C of FIG. 4.
Figure 8:
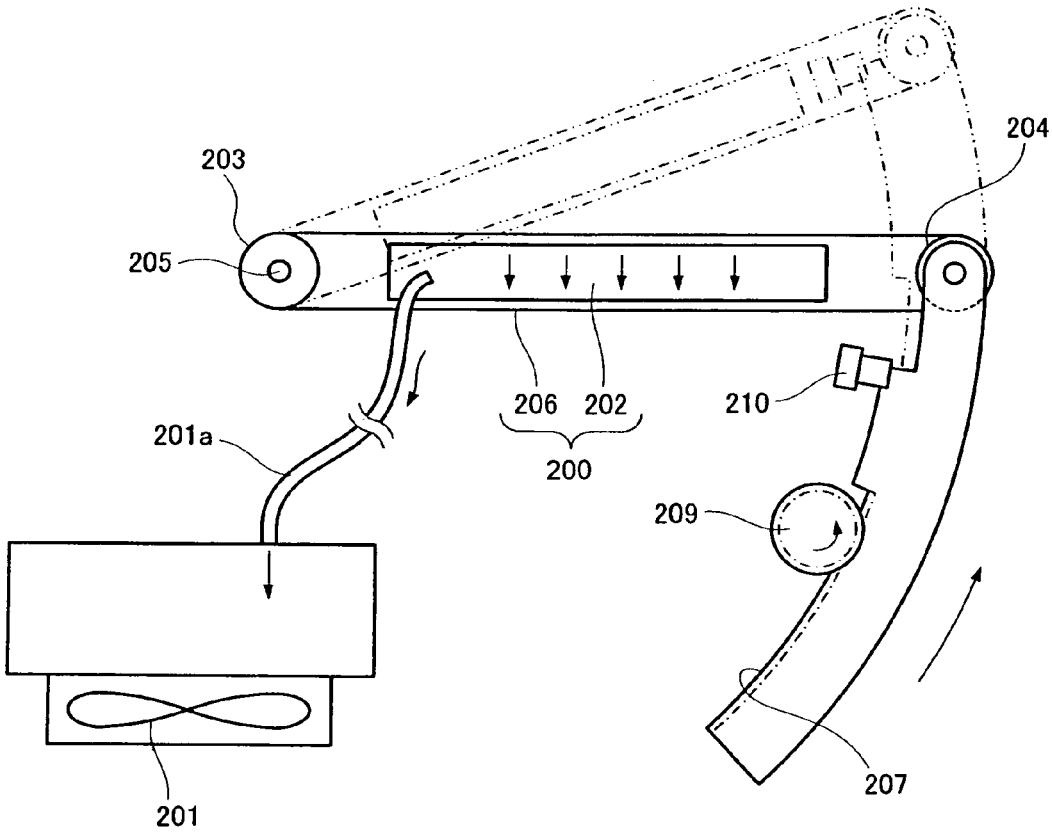
FIG. 8 is a schematic view showing another configuration of the protruding member.

As shown in FIGS. 1 and 2, the body 51 includes a suction box 81 communicating with the suction source, a pair of a drive roller 82 and a driven roller 83 which are disposed at the front and rear of the suction box 81, a drive shaft 84, and a pair of paper suction transport belts 85 looped over the rollers 82 and 83 at the front and rear. The pair of rollers 82 and 83 and the drive shaft 84 simultaneously drive the paper suction transport belts 85 disposed on the right and left. The printed sheet 71 is transported on the upper surface of the paper suction transport belt 85 by sucking air through openings 81*a* of the suction box 81 and a plurality of holes 85*a* formed on the paper suction transport belts 85.

The jumping boards 52 each have an inclined guide 91 inclined at a predetermined angle relative to a horizontal guide 92. A bending line between the inclined guide 91 and the horizontal guide 92 forms a predetermined angle relative to the paper transport direction. Thus the height of the inclined guide 91 is increased toward the leading end in the paper transport direction, so that both ends of the printed sheet 71 are corrected so as to be bent upward and the sheet ends provided in parallel with an axis disposed along a jumping direction can be smoothly curved upward. Further, the jumping board 52 can be rotated about the axis of a support shaft 52*a* and retracted to a position where the inclined guide 91 does not come into contact with the printed sheet 71.

On the paper transport surface of the paper ejecting device 5, a plurality of protruding members 100 are respectively disposed between one of the jumping boards 52 and one of the paper suction transport belts 85, between the paper suction transport belts 85 on the right and left, and between the other jumping board 52 and the other paper suction transport belt 85. In the present embodiment, the three protruding members 100 are provided. The number of protruding members 100 is properly set according to the number of paper suction transport belts 85 disposed between the jumping boards 52 on the right and left.

As shown in FIG. 2, the protruding members 100 are disposed in slits 102 formed on a frame 101 composing the paper transport surface of the paper ejecting device 5. The protruding members 100 have one ends supported by a swinging shaft 103 and are provided so as to independently swing up and down around the axis of the swinging shaft 103. Each of the protruding members 100 swings between a position where the top of the protruding member 100 protrudes upward to the maximum height from the paper transport surface and a position where the overall protruding member 100 retracts below the paper transport surface.

Under the protruding members 100, circular eccentric cams 104 are provided. The outer edges of the eccentric cams 104 come into sliding contact with the lower edges of the protruding members 100 to support the other ends of the protruding members 100.

The eccentric cams 104 are supported by drive shafts 105 at decentered positions and are disposed so as to independently rotate about the axes of the drive shafts 105. The drive shafts 105 each include a drive motor 106. The drive motors 106 are controlled by the controller 1000 to independently control the protruding members 100.

Each of the eccentric cams 104 can rotate in a range from a position where the farthest position from the drive shaft 105 on the outer edge making sliding contact with the protruding member 100 rotates upward to the maximum height to a position where the closest position to the drive shaft 105 on the outer edge rotates downward to the minimum height.

When the eccentric cams 104 rotate and the farthest position from the drive shaft 105 on the outer edge of the eccentric cam 104 comes into sliding contact with the protruding member 100, the top of the protruding member 100 protrudes upward from the paper transport surface to the maximum height. When the closest position to the drive shaft 105 on the outer edge of the eccentric cam 104 comes into sliding contact with the protruding member 100, the overall protruding member 100 retracts below the paper transport surface.

Thus the amount of protrusion of the protruding member 100 can be adjusted by controlling the rotational position of the eccentric cam 104. For this adjustment, the height of protrusion is controlled by providing an encoder (not shown) on the drive shaft 105 of the eccentric cam 104 to count the number of pulses or using a stepping motor (not shown) as the drive motor 106 of the eccentric cam 104 to count the number of steps. When the printed sheet 71 is thick, the protruding members 100 have a small amount of protrusion or are not protruded. When the printed sheet 71 is thin, the protruding members 100 have a large amount of protrusion to provide stiffness.

The following will describe the transport path of sheets in the printer of the present invention.

(Single-Sided Printing)

As shown in FIG. 10, the paper feed mechanism 2 feeds the sheets 21 one by one to the printer body 3. The transport unit 41 transports the sheet 21 by suction through the paper suction transport belt 47, and the printer body 3 performs printing on one surface of the sheet 21. The printed sheet 71 is transferred from the transport unit 41 to the paper ejecting device 5, and the paper ejecting device 5 transports the printed sheet 71 by suction through the paper suction transport belts 85 and ejects the printed sheet 71 to the paper receiving tray 61.

During single-sided printing, the printed sheet 71 may be rolled from a surface printed with liquid ink to the opposite surface. Thus when the printed sheet 71 is ejected to the paper receiving tray 61 with the printed surface directed upward, the printed sheet 71 may be curled downward from the upper surface, which is directed upward, to the undersurface into a reversed U-shape.

In this printer, the printed sheet 71 is sucked on the upper surface of the paper suction transport belts 85 of the body 51 in the paper ejecting device 5. Thus the surfaces of the printed sheet 71 are shaped according to the paper transport surface on the upper surface of the suction box 81 of the body 51 and the paper transport surfaces on the upper surfaces of the inclined guides 91 and the horizontal guides 92 of the jumping boards 52, so that the shape of the printed sheet 71 can be corrected.

Further, the paper transport surfaces of the inclined guides 91 of the jumping boards 52 are inclined at a predetermined angle relative to the paper transport surface of the body 51. Thus the printed sheet 71 having been curled into the reversed U-shape is inverted and corrected, and the printed sheet 71 is curved so as to raise the sheet ends provided in parallel with the axis disposed along the jumping direction, so that the shape of the printed and ejected sheet 71 can be adjusted to a predetermined shape.

At this point, the numbers and positions of protruding members 100 protruding from the paper transport surface are combined by control through the controller 1000. Thus the corrected shape of the sheet can be changed according to the kind (size, thickness) of paper, so that the sheet jumping from the paper ejecting device to the paper receiving tray can be ejected with a desired shape.

The following will describe the protrusion patterns of the protruding members 100.

(Correction Pattern 1, U-Shape Pattern)

Figure 9A:
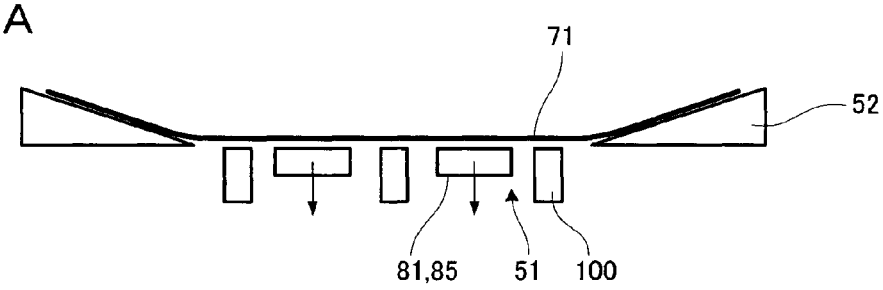
FIG. 9A is a schematic view showing a correction pattern.

As shown in FIG. 9A, when the printed sheet 71 is transported while being sucked on the upper surfaces of the paper suction transport belts 85 in the paper ejecting device 5, all the protruding members 100 entirely retract below the paper transport surface.

This pattern is used when the printed sheet 71 transported from the transport unit 41 to the paper ejecting device 5 is uncurled or is just slightly curled. The printed sheet 71 is shaped along the paper transport surfaces of the jumping boards 52 and the paper transport surface of the body 51. Only by curving the printed sheet 71 so as to raise the sheet ends provided in parallel with the axis disposed along the jumping direction, the sheet can be corrected to a U-shape, so that the shape of the printed and ejected sheet 71 can be adjusted to the predetermined shape.

Particularly when a thick sheet is used, all the protruding members 100 can be retracted below the paper transport surface and the jumping boards 52 can be rotated about the axes of the support shafts 52*a* and retracted to a position where the inclined guides 91 do not come into contact with the printed sheet 71.

(Correction Pattern 2, W-Shape Pattern)

Figure 9B:
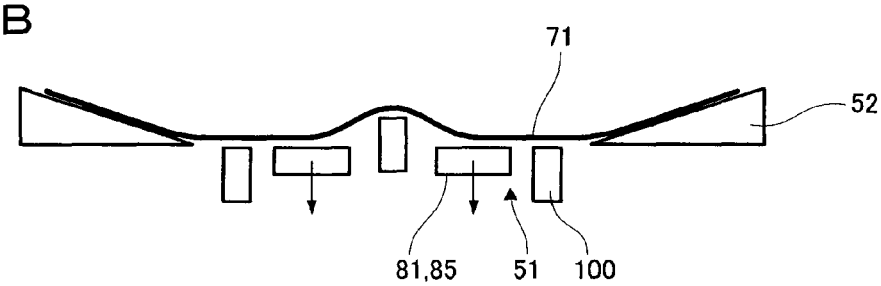
FIG. 9B is a schematic view showing a correction pattern.

As shown in FIG. 9B, when the printed sheet 71 is transported while being sucked on the upper surfaces of the paper suction transport belts 85 in the paper ejecting device 5, the protruding member 100 at the center protrudes to a predetermined height on the paper transport surface and the protruding members 100 on both sides retract below the paper transport surface.

This pattern is used when the printed sheet 71 transported from the transport unit 41 to the paper ejecting device 5 is, for example, a thin sheet having low stiffness. The printed sheet 71 is raised by the protruding member 100 at the center of the paper transport surface of the body 51, both ends of the printed sheet 71 are shaped along the paper transport surfaces of the jumping boards 52 and the paper transport surface of the body 51, and the shapes of the sheet ends provided in parallel with the axis disposed along the jumping direction are corrected so as to be curved upward, so that the shape of the printed and ejected sheet 71 can be adjusted to the predetermined shape.

By correcting the sheet into a W-shape, the apparent rigidity of the sheet, that is, the stiffness of the sheet in an axial direction along the transport direction is higher than in correction pattern 1. Thus the end of the sheet is prevented from hanging down while the sheet jumps from the paper ejecting device to the paper receiving tray.

(Correction Pattern 3, Double-Peak Pattern)

Figure 9C:
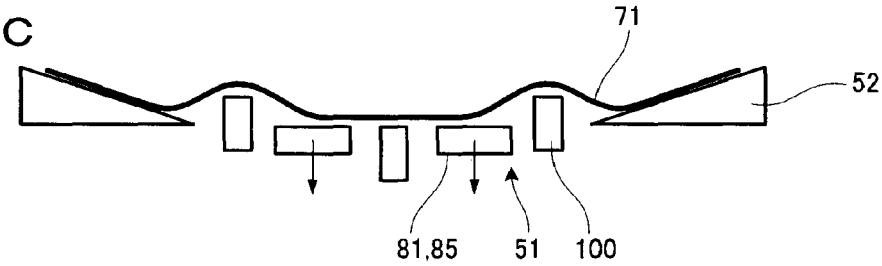
FIG. 9C is a schematic view showing a correction pattern.

As shown in FIG. 9C, when the printed sheet 71 is transported while being sucked on the upper surfaces of the paper suction transport belts 85 in the paper ejecting device 5, the protruding member 100 at the center retracts below the paper transport surface and the protruding members 100 on both sides protrude to a predetermined height on the paper transport surface.

This pattern is used when the printed sheet 71 transported from the transport unit 41 to the paper ejecting device 5 has a large size, for example, in a direction orthogonal to the transport direction. The printed sheet 71 is raised by the protruding members 100 on both sides of the paper transport surface of the body 51, that is, near the jumping boards 52, both ends of the printed sheet 71 are shaped along the paper transport surfaces of the jumping boards 52 and the paper transport surface of the body 51, and the printed sheet 71 is curved so as to raise the sheet ends provided in parallel with the axis disposed along the jumping direction, so that the shape of the printed and ejected sheet 71 is adjusted to the predetermined shape.

By raising the printed sheet 71 near the jumping boards 52, an angle between a part provided along the paper transport surface of the jumping board 52 and a part raised by the protruding member 100 decreases and a correction force increases. Thus even when the printed sheet 71 is thick, the printed sheet 71 can be ejected with a proper shape. Further, by forming the shape of the ejected sheet into a double-peak pattern, even in the case of a large sheet, the apparent rigidity of the sheet, that is, the stiffness of the sheet in the axial direction along the transport direction becomes higher than in correction pattern 2. Thus the end of the sheet is prevented from hanging down while the sheet jumps from the paper ejecting device to the paper receiving tray.

(Correction Pattern 4, Multiple-Peak Pattern)

Figure 9D:
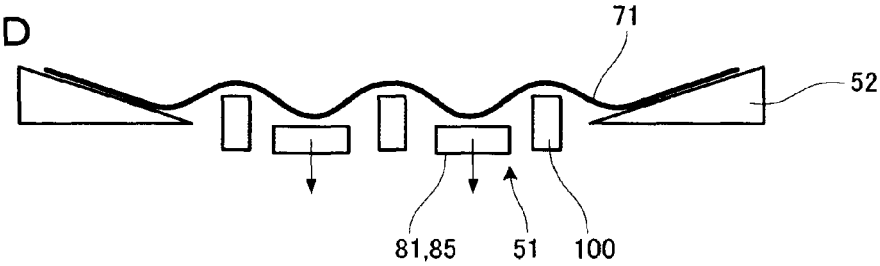
FIG. 9D is a schematic view showing a correction pattern.

As shown in FIG. 9D, when the printed sheet 71 is transported while being sucked on the upper surfaces of the paper suction transport belts 85 in the paper ejecting device 5, all the protruding members 100 protrude to a predetermined height on the paper transport surface. Further, air from the air blower 53 is blown to the sheet surface from above to press the printed sheet 71 to the paper transport surface.

This pattern is used when the printed sheet 71 transported from the transport unit 41 to the paper ejecting device 5 has a large size, for example, in a direction orthogonal to the transport direction. The printed sheet 71 is raised by the protruding members 100 at the center and both sides of the paper transport surface of the body 51, both ends of the printed sheet 71 are shaped along the paper transport surfaces of the jumping boards 52 and the paper transport surface of the body 51, and the printed sheet 71 is curved so as to raise the sheet ends provided in parallel with the axis disposed along the jumping direction, so that the shape of the printed and ejected sheet 71 is adjusted to the predetermined shape.

By combining correction patterns 2 and 3 thus, a correction force can be increased, the printed sheet 71 can be ejected with a proper shape, and the apparent rigidity of the sheet, that is, the stiffness of the sheet in the axial direction along the transport direction becomes higher than in correction pattern 3. Thus the end of the sheet is prevented from hanging down while the sheet jumps from the paper ejecting device to the paper receiving tray.

(Correction Pattern 5, Single-Peak Pattern)

Figure 9E:
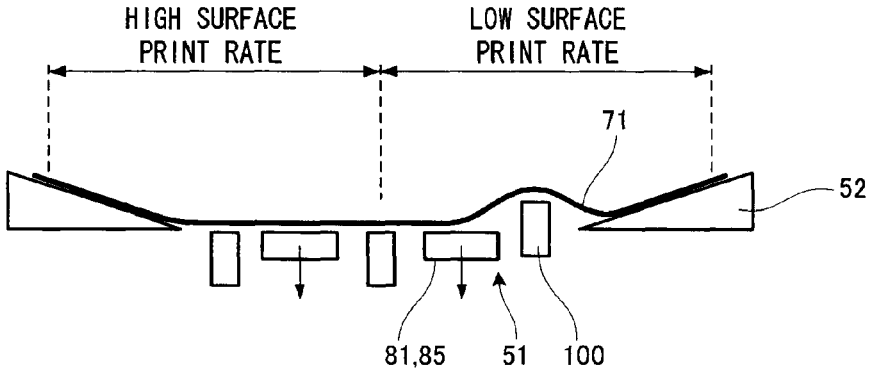
FIG. 9E is a schematic view showing a correction pattern.

As shown in FIG. 9E, when the printed sheet 71 is transported while being sucked on the upper surfaces of the paper suction transport belts 85 in the paper ejecting device 5, one of the protruding members 100 disposed on both sides protrudes to a predetermined height on the paper transport surface, and the other protruding member 100 and the protruding member 100 at the center retract below the paper transport surface.

This pattern is used when a surface print rate is biased on the same surface of the printed sheet 71 transported from the transport unit 41 to the paper ejecting device 5. On a part having a large surface print rate, the printed sheet 71 is shaped along the paper transport surfaces of the jumping boards 52 and the paper transport surface of the body 51. On a part having a small print rate, the printed sheet 71 is raised by the protruding member 100 on one side of the paper transport surface of the body 51 and the printed sheet 71 is curved so as to raise the sheet ends provided in parallel with the axis disposed along the jumping direction, so that the shape of the printed and ejected sheet 71 is adjusted to the predetermined shape.

With these correction patterns in which the printed sheet 71 is raised by the protruding member 100 on the varying positions according to the bias of the surface print rate, curling can be more properly corrected. By forming the ejected sheet into a proper shape, the apparent rigidity of the sheet, that is, the stiffness of the sheet in the axial direction along the transport direction is increased. Thus the end of the sheet is prevented from hanging down while the sheet jumps from the paper ejecting device to the paper receiving tray.

(Double-Sided Printing)

As shown in FIG. 10, the paper feed mechanism 2 feeds the sheets one by one to the printer body 3. The transport unit 41 transports the sheets 21 by suction through the paper suction transport belt 47, and the printer body 3 performs printing on one surface of the sheet 21.

After printing in the printer body 3, the printed sheet 71 is inverted in the paper transport mechanism 4 and then is returned to the feed port of the printer body 3. For this inversion, the gate 42 disposed between the paper ejecting device 5 and the transport unit 41 immediately under the printer body 3 is operated to temporarily feed the printed sheet 71 to the pair of reversing rollers 43, and then the reversing rollers 43 are reversely operated to feed the printed sheet 71 to the transport unit 41 composing a return path. After that, the gate 42 disposed between the transport rollers 25 and the transport unit 41 immediately below the printer body 3 is operated to feed back the printed sheet 71 to the feed port of the printer body 3.

The transport unit 41 transports the printed sheet 71 by suction through the paper suction transport belt 47, and the printer body 3 performs printing on the back side of the printed sheet 71. The printed sheet 71 is transferred from the transport unit 41 to the paper ejecting device 5, and the paper ejecting device 5 transports the printed sheet 71 by suction through the paper suction transport belts 85 and ejects the printed sheet 71 to the paper receiving tray 61.

During double-sided printing, the printed sheet may be rolled from a surface having a large print rate to the other surface having a small print rate. Thus during the ejection of the printed sheet 71 having undergone double-sided printing to the paper receiving tray 61, the printed sheet 71 may be curled downward into a reversed U-shape from the front side, which is directed upward, to the back side of the sheet when the front side has a higher surface print rate. The printed sheet 71 may be curled upward into a U-shape from the back side, which is directed downward, to the front side of the sheet when the back side has a higher print rate.

Thus during double-sided printing, air is blown from the air blower 53 to press both sides of the printed sheet 71 to the paper transport surfaces of the inclined guides 91 of the jumping boards 52, so that both ends of the sheet are forcibly expanded to the outside and are corrected along the paper transport surfaces of the jumping boards 52.

Air from the air blower 53 is locally blown from the center to both ends of the printed sheet 71. Thus it is possible to prevent air from blowing to unnecessary points, thereby efficiently correcting curling.

Curling of the printed sheet 71 can be positively corrected even when the printed sheet 71 is curled upward into a U-shape as well as when the printed sheet 71 is curled downward into a reversed U-shape.

As in one-sided printing, the paper transport surfaces of the inclined guides 91 of the jumping boards 52 are inclined at a predetermined angle relative to the paper transport surface of the body 51. Thus curling of the printed sheet 71 is inverted and corrected, and the printed sheet 71 is curved so as to raise the sheet ends provided in parallel with the axis disposed along the jumping direction, so that the shape of the printed and ejected sheet 71 can be adjusted to the predetermined shape.

At this point, by combining the numbers and positions of protruding members 100 protruding from the paper transport surface, the corrected shape of the sheet can be changed according to the kind (size, thickness) of paper, so that the sheet jumping from the paper ejecting device to the paper receiving tray can be ejected with a desired shape. The protrusion patterns of the protruding member 100 are similar to the foregoing patterns.

By changing the corrected shape of the sheet thus according to the kind (size, thickness) of paper, the sheet jumping from the paper ejecting device to the paper receiving tray can be ejected with a desired shape.

As shown in FIGS. 3 to 8, the protruding members 200 may have a suction/transportation function. In this case, the protruding member 200 includes a suction box 202 communicating with a fan device 201, which is a suction source, through a flexible duct 201*a*, a pair of a drive roller 203 and a driven roller 204 which are disposed at the front and rear of the suction box 202, a drive shaft 205, and a paper suction transport belt 206 looped over the rollers 203 and 204 at the front and rear. The printed sheet 71 is transported on the upper surfaces of the paper suction transport belts 206 by sucking air through a plurality of holes 206*a* formed on the paper suction transport belts 206.

The protruding members 200 are disposed in the slits 102 formed on the frame 101 composing the paper transport surface of the paper ejecting device 5. The protruding members 200 have one ends supported by the drive shaft 205 acting as a swinging shaft and the paper suction transport belts 206 of all the protruding members 200 are simultaneously operated by the drive shaft 205. The transport speeds of the paper suction transport belts 206 can be adjusted according to the kind (size, thickness) of paper. When the printed sheet 71 is thick and is transported at a high speed, the sheet comes into contact with a fixed member in the paper receiving tray 61 at an excessive speed. When the printed sheet 71 is transported at an extremely low speed, the sheet does not reach the fixed member and is poorly aligned in the paper receiving mechanism. For this reason, the transport speed is adjusted to a proper speed.

The protruding members 200 are disposed so as to independently swing up and down around the axis of the drive shaft 205, and a pinion 209 connected to a motor 208 is engaged with a rack 207 connected to the driven roller 204. The engagement of the rack 207 and the pinion 209 rotatively driven by the motor 208 enables each of the protruding members 200 to swing between a position where one end on the side of the driven roller 204 protrudes upward as a top from the paper transport surface to the maximum height and a position where the overall protruding member 200 retracts below the paper transport surface. The amount of protrusion is detected by a sensor made up of a photointerrupter 210. When the printed sheet 71 is thick, the protruding members 200 have a small amount of protrusion or are not protruded. When the printed sheet 71 is thin, the printed sheet 71 has a large amount of protrusion to provide stiffness.

The upper surface of the suction box 81 of the paper ejecting device 5 composes the paper transport surface where the holes 81*a* are formed between the protruding members 200. Thus in the paper ejecting device 5, the sheets are transported by the paper suction transport belts 206 of the protruding members 200. In the present embodiment, the three protruding members 200 are provided and the number of protruding members 200 may be set as needed. The numbers and positions of protruding members 200 protruding from the paper transport surface are combined by control through the controller 1000, so that the corrected shape of the sheet can be changed according to the kind (size, thickness) of paper.

In the foregoing configuration, the sheets of the printer are transported through the same path in single-sided printing and double-sided printing which have been described in the foregoing embodiment. Further, the same correction patterns are used in single-sided printing and double-sided printing and thus the explanation thereof is omitted. In this configuration, the printed sheet 71 is sucked on the upper surfaces of the paper suction transport belts 206 of the protruding members 200 while being sucked on the paper transport surface of the paper ejecting device 5, so that correction can be positively performed. The corrected shape of the sheet can be changed according to the kind (size, thickness) of paper, so that the sheet jumping from the paper ejecting device to the paper receiving tray can be ejected with a desired shape.

What is claimed is:

1. A paper ejecting device, comprising:

a body for sucking a sheet of paper on a paper transport surface;

jumping boards having paper transport surfaces and being provided on both sides of the body along a paper transport direction;

a plurality of protruding members disposed so as to independently swing up and down around an axis of a swinging shaft for supporting one ends of the protruding members;

swinging devices for swingingly driving the protruding members from a position where the protruding members have top portions composing other ends of the protruding members and protruding upward to a predetermined height from the paper transport surface to a position where the protruding members retract below the paper transport surface; and a controller for controlling the swinging devices and combining swinging positions of the protruding members according to one of the kind of paper and a bias of a surface print rate of the sheet;

wherein each of the protruding members integrally and individually has a suction box, a pair of a drive roller and a driven roller disposed at the front and rear of the suction box, a paper suction transport belt individually associated with the suction box and looped over the rollers at the front and rear of the suction box, and a plurality of holes formed on the paper suction transport belt, whereby a printed sheet is transported on the upper surface of the paper suction transport belt by sucking air through the plurality of holes.

2. The paper ejecting device according to claim 1, wherein the controller controls the driving of the swinging devices according to a bias of a surface print rate of the sheet in a direction perpendicular to the paper transport direction.

3. The paper ejecting device according to claim 2, wherein the controller moves the protruding members to the first position, the protruding members corresponding to an area where a surface print rate of the sheet is relatively low.

4. The paper ejecting device according to claim 3, wherein the controller moves the protruding members to the second position, the protruding members corresponding to an area where a surface print rate of the sheet is relatively high.

5. The paper ejecting device according to claim 1, wherein the protruding members are respectively disposed between one of the jumping boards and one of the paper suction transport belts, between the paper suction transport belts on the right and left, and between the other jumping board and the other paper suction transport belt.

6. The paper ejecting device according to claim 1, wherein the controller adjusts a transport speed of the suction transport belt according to the kind of paper.

* * * * *